United States Patent [19]

Lambert, Jr. et al.

[11] 4,311,305

[45] Jan. 19, 1982

[54] CHEST AND BUST MACHINE

[76] Inventors: Lloyd J. Lambert, Jr.; Lloyd J. Lambert, Sr., both of 1538 College Ave., South Houston, Tex. 77587

[21] Appl. No.: 100,177

[22] Filed: Dec. 4, 1979

[51] Int. Cl.[3] ..... A63B 23/02

[52] U.S. Cl. ..... 272/118; 272/134

[58] Field of Search ..... 272/93, 117, 118, 134, 272/72, 128–131, 135, 138

[56] References Cited

U.S. PATENT DOCUMENTS

| | | | |
|---|---|---|---|
| 329,653 | 11/1885 | Kitchen | 272/134 |
| 3,017,180 | 1/1962 | Aronsohn | 272/134 X |
| 3,345,067 | 10/1967 | Smith | 272/134 |
| 3,558,131 | 1/1971 | Dragon | 272/134 |
| 3,572,700 | 3/1971 | Mastropaolo | 272/130 X |
| 3,627,315 | 12/1971 | Marcyan | 272/134 X |
| 3,708,166 | 1/1973 | Annas | 272/118 X |
| 3,807,728 | 4/1974 | Chillier | 272/118 |
| 3,850,431 | 11/1974 | Winans | 272/134 X |
| 3,858,873 | 1/1975 | Jones | 272/117 |
| 3,878,198 | 4/1975 | Seligman | 272/134 X |
| 3,912,261 | 10/1975 | Lambert | 272/134 X |
| 3,966,201 | 6/1976 | Mester | 272/72 |
| 4,149,714 | 4/1979 | Lambert | 272/118 |
| 4,183,520 | 1/1980 | Chase | 272/130 |
| 4,184,675 | 1/1980 | Rogerson | 272/130 X |

FOREIGN PATENT DOCUMENTS

| | | | |
|---|---|---|---|
| 750826 | 1/1967 | Canada | 272/134 |
| 2210191 | 9/1973 | Fed. Rep. of Germany | 272/72 |
| 2656534 | 6/1978 | Fed. Rep. of Germany | 272/134 |
| 117216 | 7/1918 | United Kingdom | 272/134 |
| 1153143 | 5/1969 | United Kingdom | 272/130 |
| 635999 | 12/1978 | U.S.S.R. | 272/117 |

OTHER PUBLICATIONS

"Total Conditioning: A Case Study" from Athletic Journal, vol. 56, Sep. 1975, pp. 1–16.

*Primary Examiner*—Richard J. Apley

*Attorney, Agent, or Firm*—Victor J. Evans & Co.

[57] ABSTRACT

Disclosed herein is a chest and bust machine defined by a base frame from which emanates a plurality of upwardly extending support rods on a pair of which is deployed a vertical back support and a vertically adjustable seat mechanism. Provided in front of the back and seat areas there is a pair of spaced parallel pivot arms pivotted to the base frame at its lowermost extremity and connected at an upward extremity thereof to a plurality of chains which interact with sprockets disposed upon a common axle which, when rotated, rotates a cam disposed therebetween. The cam is connected to a further chain which operates a plurality of weights the magnitude of which is selectable. Work is done by rotating the pivot arms away from the user of the machine so as to provide chest and bust development in such a fashion that the exerciser is constrained from allowing any other muscles to contribute in the exercise, and the work done is on a direct drive basis.

10 Claims, 4 Drawing Figures

CHEST AND BUST MACHINE

BACKGROUND OF THE INVENTION

Various types of weight machines have existed in the prior art in an attempt to provide development for chest and bust areas with a minimal amount of contribution by other muscles.

Perhaps the most primitive and least exclusive devices of this type are barbells in which the exerciser is to perform a press-type of exercise.

The state of the art thereafter has developed to define a machine in which the exerciser is on an inclined back support having an orthogonally disposed seat and provided on opposed sides of one's shoulder, mechanisms substantially below or behind the plane defined by the back support i.e. a pair of rods operatively connected to the weight mechanism through a drive. This machine, while providing a marked improvement over the existing prior art at the time, required the use of foot pedals which would cause the two bars to come up beyond the plane of the back support so that they could be grasped for further exercising, after which the leg assist would be discontinued. Clearly, the benefits associated with a device of this type included allowing the handle members that serve to perform a portion of the exercise to extend back behind the user so that during a repitition of the exercise, the chest and bust muscles could be stretched beyond what would be possible with a barbell. However, since the weight take-up mechanism is located at the bottom portion of the exercise bars, the user benefits from the length of the exercise bar arms, and the torque associated with the length of the moment arm multiplies the exerciser's actual force expended.

SUMMARY AND OBJECTS OF THE INVENTION

By way of contrast, the instant application is directed to a *direct* drive mechanism in which the effects of a moment arm have been substantially negated since the weight pick up and drive linkage is at the topmost extremities of the pivot arms so that a true indication of the work done as reflected by the magnitude of the weights is possible.

Accordingly, an object of this invention is to provide a device of the character described above which provides a substantially direct drive system so as to off-set any benefits that had been accrued by means a longer moment arm.

A further object of this invention contemplates providing the user of the machine with his back in a substantially vertical plane so that the most beneficial orientation of the chest and bust area relative to the work can be properly maintained at all times.

It is a further object of this invention to provide a device of the character described above which is safe to use, reliable in construction, and extremely effective in performing the exercise.

A further object in accordance with the above defined benefits contemplates providing a direct drive mechanism which is counter-balanced so that the weight of all systems and components exclusive of the actual weight plates can be negated so that children and women can perform the exercise without having to already have achieved a level of physical fitness which the prior art would dictate because of the weight associated inherently with the system.

A further object is to provide a device of the character described above in which the seat area is vertically adjustable to accomodate people of various dimensions.

A further object contemplates providing a head pad guard area to isolate the user of the machine from various moving components.

These and other objects will be made manifest when considering the following detailed specification when accompanied with the appended drawings.

BRIEF DESCRIPTION OF THE PREFERRED EMBODIMENT

Figure 1:
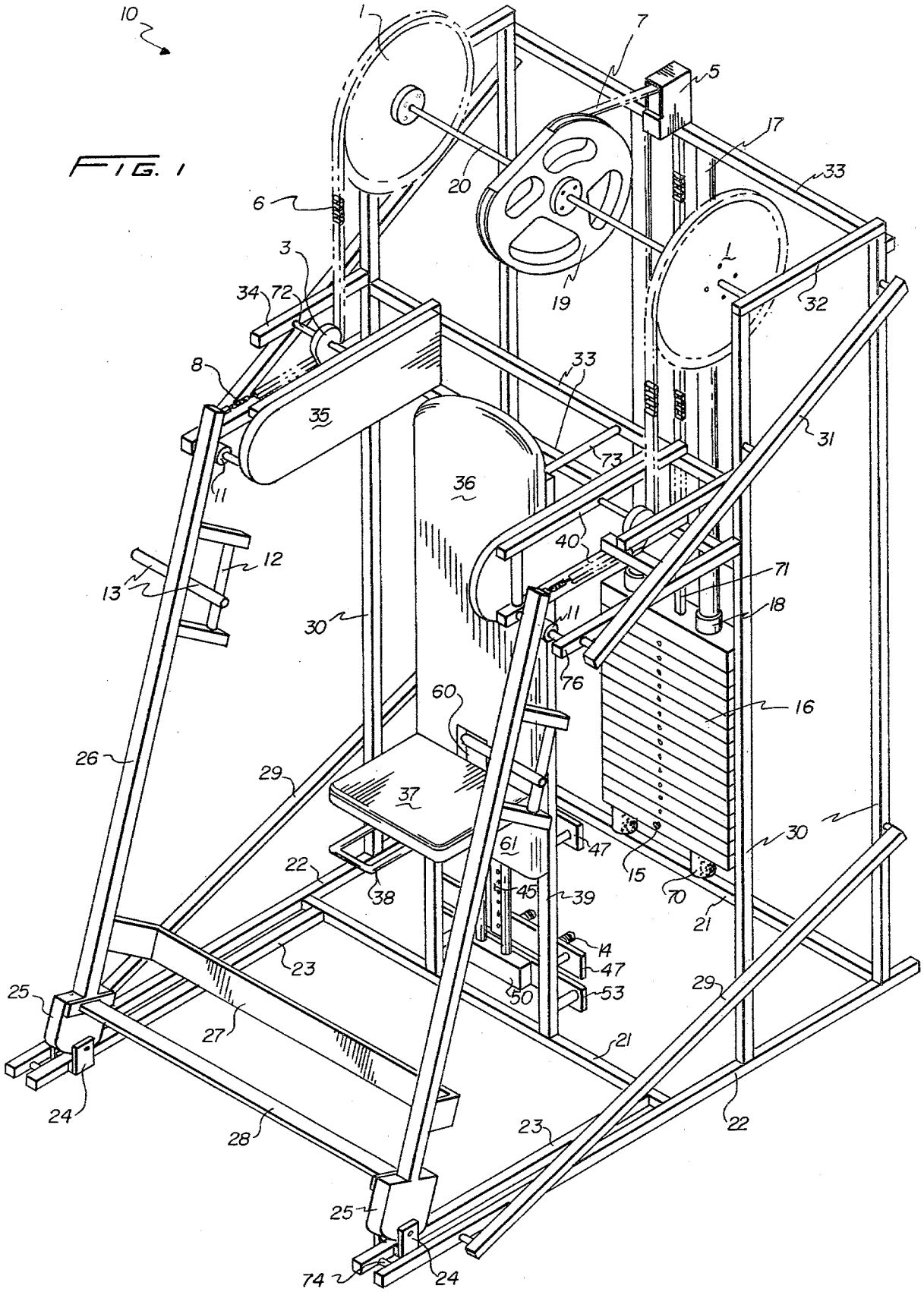
FIG. 1 is a perspective view of the apparatus according to the present invention.
Figure 2:
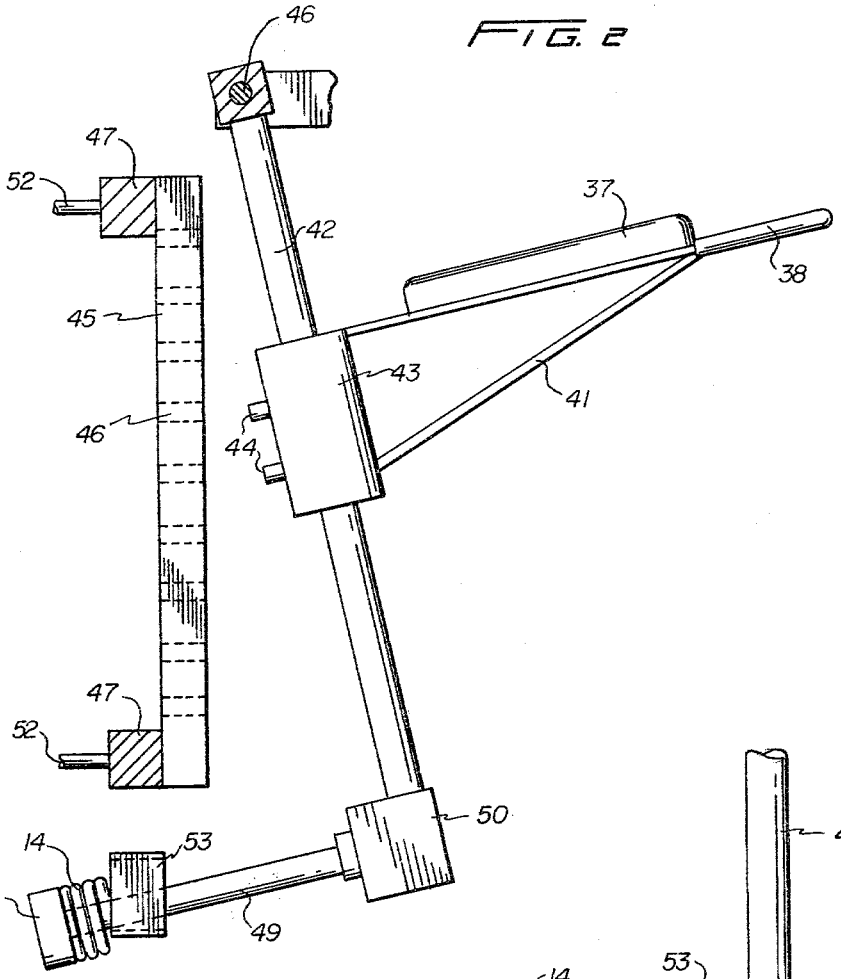
FIG. 2 is a side view of a portion of the mechanism depicting the seat adjusting mechanism.
Figure 3:
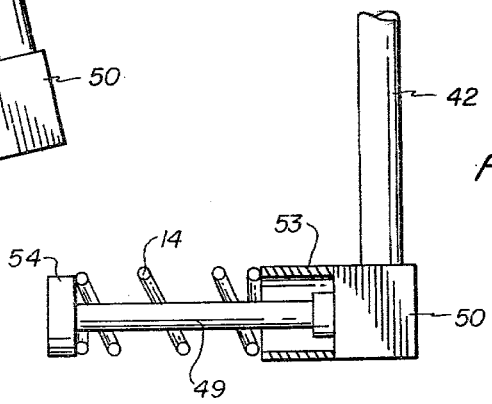
FIG. 3 details an additional component of the seat adjusting mechanism.
Figure 4:
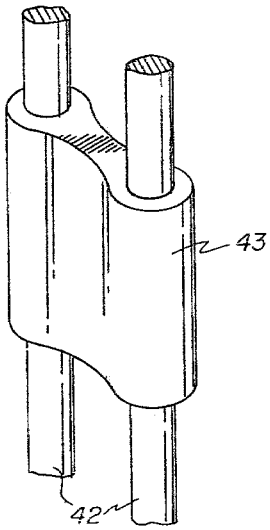
FIG. 4 is a perspective view of two elements associated with the seat adjustment.

Referring to the drawings now, wherein like reference numerals refer to like parts throughout the several drawings, reference numeral 10 is directed to the chest and bust machine according to the present invention.

This chest and bust machine can generally be regarded as being provided with a base frame defined by a rectangular grid having spaced parallel base members 21 interconnected by a second set of frame members 22 whose lengths extend substantially beyond terminal portions of the first above mentioned base members 21 forwardly whereupon a second pair of base frame members 23 are co-extensive therewith for purposes to be assigned later.

A weight supporting cage defined by vertical column members 30 extends upwardly at a rear portion of the base frame and are inter-braced at top extremities thereof as by crossbars 32, and the vertical column members 30 are further inter-braced at a topmost extremity with bar element 33 and further downward toward the front of the machine an additional bar 33.

Disposed within the weight cage two spaced parallel tubes 17 extend from the top of the machine at 33 to the base 21 and at the most portion thereof cushions 70 are provided upon which a plurality of weights 16 are deployed supported on the tubes 17 through brass bushings 18. The magnitude of the weights are selectably adjustable by means of a pin 15 which extends within holes provided on the weights 16. In order to raise the weights, a downwardly extending weight carrier 71 has plural holes disposed therein which are meant to co-align with the holes on the weight plates so that when the pin 15 is disposed therethrough the weights can be picked up. The carrier 71 is connected to a chain 7 which changes direction from a vertical sense to a horizontal one as shown by a sprocket having a cover 5. The chain 7 terminates on a cam 19 supported on an axle 20 carried by the cross bars 32 as shown in FIG. 1. An opposed extremities of the axle 20 there are provided a pair of sprockets 1 having second and third chains 6 wrapped thereon wherein the chains 6 extends vertically downward and then through a further sprocket 3 thereafter and terminate at the topmost portions of pivot arms 26 on either side of a bench support now to be defined. However, it is important to note that these chains are provided with a chain adjuster 8 so as to adjust the slack therein. The sprocket 3 is supported on an outwardly extending bar member 34 at one extremity and one of two vertically spaced head pad support bars 40 through an axle 72. The head pad supports 35 are placed on either side of a vertical planar back support 36 at a topmost extremity so that the head pads 35 while being braced on and carried by the extending head support bars 40 isolate and exclude the exerciser from the chains 6, sprocket 3, and chain adjuster 8 as clearly shown.

The vertical back support 36 is supported by a pair of upwardly extending column members 39 inter-braced with the weight cage as by 33 having rods 73 extending therebetween, and the column members 39 also serve to support the vertically adjustable seat 37 having adjustment handle 38 now to be defined. However, it is to be noted that the vertical back support 36 has a lowermost terminal portion that is bifurcated so that two tail portions 61 and an empty space 60 is provided medially therebetween so that the seat 37 can extend up and down between these two tail portions.

As shown in FIG. 1, the co-extensive base frame members 23 which parallel a major portion of the frame members 22 are connected to the base members 21 and inter-braced by pin elements 74 at the terminal portions thereof so that they are firmly affixed thereto. The pivot arm 26 is fastened to an outer extremity of the co-extensive base frame 23 by means of upwardly extending U-shaped clamps 24 which provide a pivot pin that extends through an enlarged base portion 25 of the pivot arm 26.

The lowermost enlarged portion 25 of the pivot arm 26 is reinforced having a substantially solid U-shaped configuration the topmost portion of which is inter-connected with the other pivot arm base 25 by means of cross-brace 28 having a substantially I-shaped configuration. Slightly further upwardly on the pivot arm a U-shaped steel brace 27 connects the two pivot arms so that the open area of the "U" faces away from the exerciser and the reason these two pivot arms are firmly affixed together is to not only prevent the topmost portions of the pivot arms from bending due to excessive weight, but also to assure that the exercise is performed with each arm in synchrony.

Up around chest level of the user, handle members are provided, three on each pivot arm. The first hand grip member can generally be regarded as an inverted U-shaped handle bar 12, the open end of the "U" facing away from the exercisor and the open end being attached to the pivot arm in such a manner that the handle bar 12 and the top and bottomost portions thereof when combined with the pivot arm provide a closed rectangular area. Medially disposed and orthogonal to the plane defined by the closed area of the first handle 12 a pair of rod members 13 extend outwardly on either side of the pivot arm 26 so as to provide a grasping area either inside the pivot arm or outside. It is to be appreciated that the disposition of one's hands inwardly or outwardly and rotated as these three types of handle bars provide can offer a slightly different degree of difficulty in performing the bench press exercise. In viewing FIG. 1, in order to reduce the amount of clockwise rotation of the pivot arms, a bumper stop 11 extends between one of the head support bars 40 and another frame member 76 parallel therewith so that the pivot arms are stopped at an optimum distance away from the exerciser.

The frame is further provided with four angulated braces, two on each side which bear the reference numerals 31 and 29 respectively, and these angulated braces extend from the frame member 76 and pinned to vertical column members 30 in the upper one, and between a horizontal frame member 22 and the weight cage having the upstanding vertical column members 30. These of course provide additional structural rigidity for the frame mechanism which carries the weights, the chair, and the like so that greater reliability and durability of the machine is assured.

The seat adjusting mechanism is defined by a seat 37 having a handle adjustment 38 and a triangular frame member in which the hypotenuse 41 interconnects the support for the seat 37 with a sliding block 43 the back face of which is provided with pin elements 44 adapted to co-act with holes 46 carried on a vertical apertured bar 45. The apertured bar 45 is supported on the column members 39 by means of upper and lower crossbars 47 spaced from the columns 39 by means of extension pins 52. The sliding block 43 is slidably disposed on a pair of rods 42 the top extremity of which is pivotted at 46 which in turn is fastened to the column members 39. The lowermost portion 50 has a backwardly (toward the weights) extending rod 49 which slides through a support guide 53 also carried on the vertical upstanding column members 39. Directly behind the guide 53 is a spring overlying the shaft 49 and a cap 54 is provided at the extremity of the rod 49 so that when the handle 38 is pulled upwardly, the pins 44 are retracted from the holes 46 and the seat is allowed to slide up and down in between the bifurcated tail portions 61 of the vertical back support. Upon releasing the spring tension 14, the pins will co-act with and slide into a further hole 46 on the bar 45 for height translation of the seat. It is to be noted that the seat mechanism is capable of adjustment by the counter-clockwise rotation of the rods 42 away from the apertured bar 45 and that the seat 37 can be adjusted while a person is on the machine by simply pulling on the handle and providing either weight on the backmost portion of the seat 37 near the back support 36 or by pulling upwardly.

Having thus described the invention it should be apparent that numerous structural modifications are contemplated as being part of the invention as set forth herein above and as defined herein below by the claims.

What is claimed is:

1. An improved chest and bust exercise machine comprising in combination: a framework comprising a base frame having a plurality of horizontal, floor engaging frame members, a plurality of upwardly extending frame members emanating vertically from said horizontal, floor engaging frame members, a plurality of upwardly extending frame members, a pair of said vertical frame members constituting support rods, a vertical back support fastened to said pair of support rods, a substantially horizontal seat supported by said pair of support rods, said seat extending outwardly from said back support and being provided with means for adjusting the height of said seat, a pair of spaced parallel pivot arms having means pivotally attaching their lowermost extremity to a pair of said horizontal frame members so that each of said pivot arms extends forwardly of and on opposed sides of said back support and seat, said pivotal attaching means being disposed such that the rotative movement of said pivot arms is in spaced vertical planes forwardly of said back support and seat, and weight means attached to said pivot arms at each of their respective upper extremity and to at least the upper portion of said framework to provide a direct drive mechanism so that a user positioned on said back support and seat will rotate the pivot arms outwardly therefrom thereby providing chest and bust development on a direct drive basis.

2. The device of claim 1 in which said base frame has at opposed sides along a top extremity thereof a pair of spaced opposed parallel head shields which serve to protect and isolate a user's head from a portion of said weight means.

3. The device of claim 2 wherein each of said pivot arms are provided with handle means comprising inwardly and outwardly extending posts so that the user can grasp inside or outside of said pivot arms and said handle means further includes U-shaped handgrips on said pivot arms.

4. The device of claim 3 wherein said weight means comprises chains extending horizontally from top portions of said pivot arms, said chains underlying sprockets and continuing thereafter to a pair of larger sprockets, both of which are supported on a single axle disposed on the upper portion of said base frame, a cam carried on said axle disposed between said larger sprockets, further chain connected to said cam extending rearwardly away from said vertical back support over a further sprocket and thence downwardly to a plurality of weights including means for adjusting the magnitude of said weights whereby rotation of said pivot arms rotates said larger sprockets and causes said further chain to be wrapped on said cam, lifting said weights.

5. The device of claim 4 wherein pivot arm stops are provided on said base frame for limiting the pivotal movement of said pivot arms towards said user to a predetermined location.

6. The device of claim 5 wherein chain adjustors are disposed on said chains to remove slack therein.

7. The device of claim 6 wherein lower portions of said pivot arms are provided with interconnected bracking member means to synchronize motion of both pivot arms.

8. The device of claim 7 wherein said framework includes horizontal crossbars interconnecting and bracing said vertical support rods and vertically spaced, angularly disposed braces on opposed sides of said framework.

9. The device of claim 8 wherein said means for adjusting said seat comprises a pair of spaced cylindrical rods connected to said framework, a sliding block provided with a triangular frame, disposed on both said rods spaced cylindrical rods for supporting said seat plural pin elements on said sliding block remote from said triangular frame, an apertured bar carried on said base frame adapted for reception therein of said pins, and biasing means at the lowermost extremities of said spaced cylindrical rods to maintain said pins in said apertures.

10. The device of claim 1 in which said vertical back support has a bifurcated lower extremity disposed on opposed sides of said seat.

* * * * *